US010663246B1

(12) United States Patent
Gelernter

(10) Patent No.: US 10,663,246 B1
(45) Date of Patent: May 26, 2020

(54) FIREARM SUPPRESSOR INCLUDING A SLEEVE

(71) Applicant: Daniel Edwards Gelernter, New York, NY (US)

(72) Inventor: Daniel Edwards Gelernter, New York, NY (US)

( * ) Notice: Subject to any disclaimer, the term of this patent is extended or adjusted under 35 U.S.C. 154(b) by 0 days.

(21) Appl. No.: 16/431,531

(22) Filed: Jun. 4, 2019

(51) Int. Cl.
*F41A 21/30* (2006.01)
*F41A 21/28* (2006.01)
*F41A 35/04* (2006.01)

(52) U.S. Cl.
CPC ..... *F41A 21/30* (2013.01); *F41A 21/28* (2013.01); *F41A 35/04* (2013.01)

(58) Field of Classification Search
CPC ..... F41A 21/30; F41A 21/32; F41A 21/34
USPC ..... 89/14.4; 181/223
See application file for complete search history.

(56) References Cited

U.S. PATENT DOCUMENTS

| | | | |
|---|---|---|---|
| 7,963,063 | B2 | 6/2011 | Camarillo |
| 2010/0170135 | A1 | 7/2010 | Tompkins et al. |
| 2019/0063859 | A1 | 2/2019 | Gilpin |

*Primary Examiner* — Reginald S Tillman, Jr.
(74) *Attorney, Agent, or Firm* — Patent Yogi LLC; Dhiraj Jindal

(57) ABSTRACT

A firearm suppressor configured to be attached to a muzzle of a firearm is disclosed. Further, the firearm suppressor may include a sleeve configured to envelop a suppressor body. Further, the sleeve may include at least one layer. Further, the at least one layer may be constructed, at least in part, of a flexible material. Further, the firearm suppressor may include the suppressor body. Further, the suppressor body may extend between a first end and a second end. Further, the first end may include a first suppressor opening. Further, the first end may be configured to be physically coupled to the muzzle of the firearm. Further, the second end may include a second suppressor opening configured to provide an outlet to a discharged ammunition round from the firearm.

14 Claims, 18 Drawing Sheets

FIREARM SUPPRESSOR INCLUDING A SLEEVE

TECHNICAL FIELD

Generally, the present disclosure relates to the field of firearms. More specifically, the present disclosure relates to a firearm suppressor including a sleeve.

BACKGROUND

The field of firearms is technologically important to several industries, business organizations and/or individuals. In particular, firearms, and associated apparatuses are used by security firms, hunters and sportsmen. Some examples of such firearms include, but are not limited to, pistols, rifles, and shotguns.

Generally, firearms produce sounds of high intensity when operated. Accordingly, firearm suppressors have been developed to muffle the sound, muzzle blast, and shockwave generated by firearms. Typical design of a firearm suppressor consists of an internal series of baffles and an exterior sleeve, traditionally made of metal. The baffles may be held in place externally or may be all of a single piece (called as a 'monocore').

While the use of a metallic exterior sleeve provides several benefits, such as, for example, sturdiness and resistance to wear, the performance with regard to sound attenuation is sub-optimal owing to the rigidity of metal. Therefore, there is a need for improved firearm suppressors including a sleeve that may overcome one or more of the above-mentioned problems and/or limitations.

BRIEF SUMMARY

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a firearm suppressor configured to be attached to a muzzle of a firearm. Further, the firearm suppressor may include a sleeve configured to envelop a suppressor body. Further, the sleeve may include at least one layer. Further, the at least one layer may be constructed, at least in part, of a flexible material. Further, the firearm suppressor may include the suppressor body. Further, the suppressor body may extend between a first end and a second end. Further, the first end may include a first suppressor opening. Further, the first end may be configured to be physically coupled to the muzzle of the firearm. Further, the second end may include a second suppressor opening configured to provide an outlet to a discharged ammunition round from the firearm.

Further disclosed herein is firearm suppressor configured to be attached to a muzzle of a firearm. Further, the firearm suppressor may include a flexible sleeve configured to envelop a suppressor body. Further, the flexible sleeve may include an elongated housing extending between a first opening and a second opening. Further, the elongated housing may include a hollow space. Further, the elongated housing may be configured to envelop the suppressor body. Further, the flexible sleeve may include at least one layer. Further, the at least one layer is constructed, at least in part, of a flexible material. Further, the firearm suppressor may include the suppressor body. Further, the suppressor body may extend between a first end and a second end. Further, the first end may include a first suppressor opening. Further, the first end may be configured to be physically coupled to the muzzle of the firearm. Further, the second end may include a second suppressor opening configured to provide an outlet to a discharged ammunition round from the firearm.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION

Figure 1:
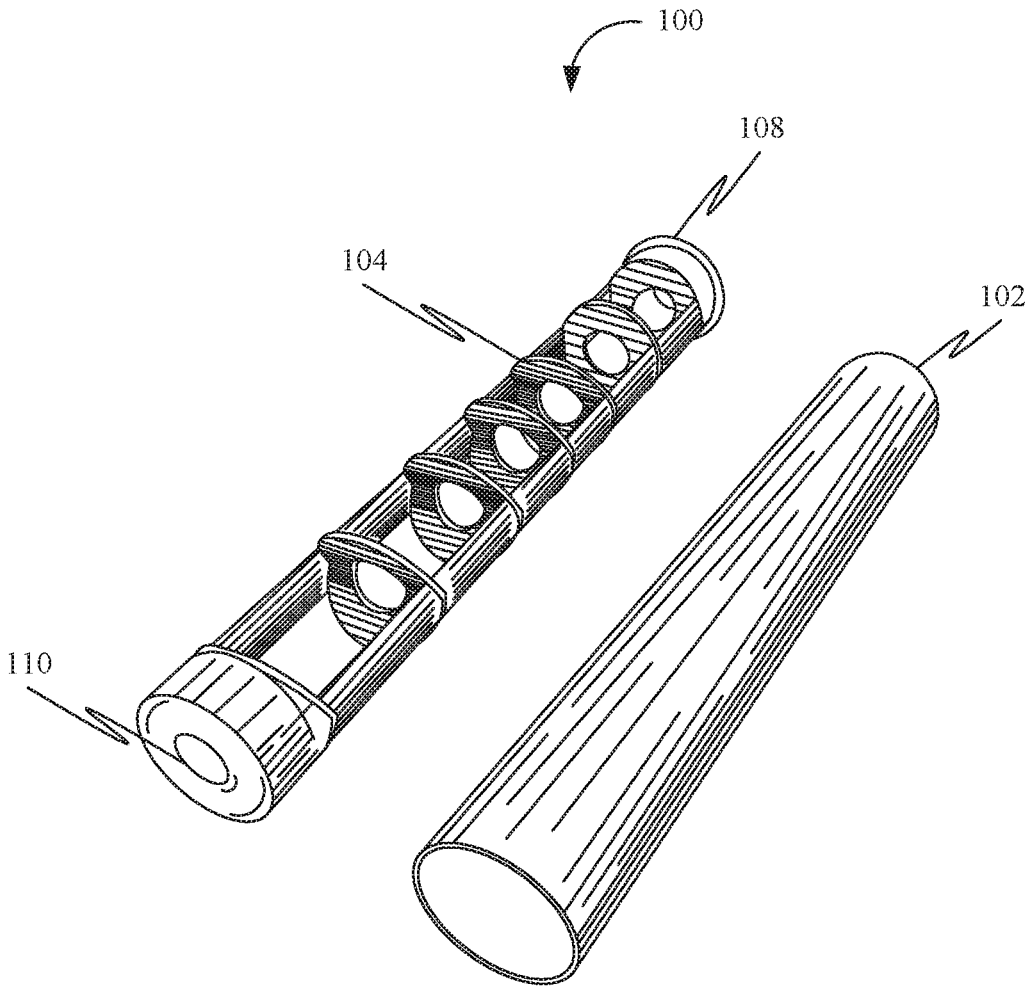
FIG. 1 is an exploded view of a firearm suppressor configured to be attached to a muzzle of a firearm, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a firearm suppressor including a sleeve, embodiments of the present disclosure are not limited to use only in this context.

FIG. 1 is an exploded view of a firearm suppressor 100 configured to be attached to a muzzle of a firearm, in accordance with some embodiments. Further, the firearm suppressor 100 may include a sleeve 102 configured to envelop a suppressor body 104. Further, the sleeve 102 may include at least one layer. Further, the at least one layer may be constructed, at least in part, of a flexible material. For instance, the at least one layer may be constructed of materials such as (but not limited to) leather, rubber, nylon, and/or any synthetic material (such as polyethylene), etc. Further, in some embodiments, the at least one layer may be constructed of materials such as (but not limited to) Polyamides (PA) or (nylons), Polycarbonate (PC), Polyester (PES), Polyethylene (PE), High-density polyethylene (HDPE), Low-density polyethylene (LDPE), Polyethylene terephthalate (PET), Polypropylene (PP), Polystyrene (PS), High impact polystyrene (HIPS), Polyurethanes (PU), Polyvinyl chloride (PVC), Polyvinylidene chloride (PVDC), Acrylonitrile butadiene styrene (ABS), Polycarbonate/Acrylonitrile Butadiene Styrene (PC/ABS), Polyethylene/Acrylonitrile Butadiene Styrene (PE/ABS). Further, the at least one layer may be constructed of aramids, including, but not limited to Kevlar, Twaron, Nomex, New Star, and Teijinconex. Further, the firearm suppressor 100 may include the suppressor body 104. Further, the suppressor body 104 may extend between a first end 108 and a second end 110.

Further, the first end 108 may include a first suppressor opening. Further, the first end 108 may be configured to be physically coupled to the muzzle of the firearm. Further, the second end 110 may include a second suppressor opening configured to provide an outlet to a discharged ammunition round from the firearm.

Further, in some embodiments, the sleeve 102 may comprise a heat resistant material. Further, the heat resistant material may include at least one of Polybenzimidazole (PBI), Aramids—para and meta, FR cotton, Coated Nylon, Carbon foam (CFOAM), Polyhydroquinone—dimidazopyridine, Melamine, Modacrylic, and Leather. Further, the heat resistant material may be insulant to heat, and may aid in cloaking the temperature of the firearm suppressor 100. Accordingly, the heat resistant material may reduce a heat signature of the firearm suppressor 100, and may allow the firearm suppressor 100 to be used more effectively in hunting or other operations requiring stealth. For instance, the heat resistant material may allow cloaking of the firearm suppressor 100 from hyperspectral scanners, and may allow the firearm suppressor to be used stealthily without giving away a position of the firearm suppressor 100, and therefore the firearm when the firearm may be used. Further, the heat resistant material may allow the firearm suppressor 100 to be safely handled by a user after use.

Further. the heat resistant material may reduce a temperature of the firearm suppressor 100, and may allow the firearm suppressor to be detached from the firearm safely.

Further, in an embodiment, the firearm suppressor 100 may include a temperature sensor configured to sense a temperature of the firearm suppressor 100, and an ambient temperature of an environment surrounding the firearm. Further, the firearm suppressor 100 may include a coolant storage and dispatch mechanism. Further, the temperature sensor may control the dispatch of the coolant after discharge of an ammunition round to maintain the temperature of the firearm suppressor 100 in a predetermined range of the ambient temperature. For instance, upon discharge of the ammunition round, the temperature sensor may be configured to sense the temperature of the firearm suppressor 100. Further, upon sensing an increase in the temperature of the firearm suppressor 100, the coolant storage and dispatch mechanism may be configured to secret a predetermined amount of coolant to reduce the temperature of the firearm suppressor 100 to within a predetermined range of the ambient range of the ambient range of the firearm suppressor. Further, the reducing the temperature of the firearm suppressor 100 may aid in cloaking the temperature of the firearm suppressor 100. Accordingly, the coolant storage and dispatch mechanism may aid in reducing a heat signature of the firearm suppressor 100, and may allow the firearm suppressor 100 to be used more effectively in hunting or other operations requiring stealth. For instance, reducing the temperature of the firearm suppressor 100 may allow cloaking of the firearm suppressor 100 from hyperspectral scanners, and may allow the firearm suppressor 100 to be used stealthily without giving away a position of the firearm suppressor 100, and therefore the firearm when the firearm may be used. Further, the reducing the temperature of the firearm suppressor 100 may allow the firearm suppressor 100 to be safely handled by a user after use.

Further, in some embodiments, the sleeve 102 may include a visual design embodied on a surface of the sleeve 102. For instance, the visual design may be printed, painted, woven or stamped on the surface of the sleeve 102. Further, the visual design may include customized design elements, such as camouflage patterns, names, colors, slogans, fictional characters, and so on. Further, the visual design may allow for a customization and personalization of the firearm suppressor 100.

Further, in some embodiments, the sleeve 102 may include multiple layers. Further, in an instance, the multiple layers may be constructed of different materials. For instance, if the sleeve 102 is constructed of 3 layers, the 3 layers may be constructed of Kevlar, Rubber, and Carbon Foam. Further, in an instance, the multiple layers may be constructed of a same material. For instance, the sleeve 102 may be constructed of multiple layers of Kevlar, multiple layers of carbon foam, multiple layers of rubber, and so on.

Further, upon being attached to a barrel of a firearm, the sleeve 102 may be configured to momentarily expand under a pressure impulse of discharge gasses released along with a discharged ammunition round and absorb a pressure impact of the discharge gasses. Further, the discharge gasses released along with the discharged ammunition round released from the firearm may enter the firearm from the first opening. Further, the sleeve 102 may be configured to momentarily expand under the pressure impulse of the discharge gasses, and absorb the pressure impact of the discharge gasses to provide sound attenuation. Accordingly, a velocity of the discharge gasses may be reduced. Further, the discharged ammunition round, and the discharge gasses may exit the firearm suppressor 100 from the second opening.

Further, in some embodiments, the sleeve 102 may be asymmetrical and may be of an irregular shape. For instance, the sleeve 102 may be of a conical shape. Further, a radius of the sleeve 102 may be lower towards the first end 108, and greater towards the second end 110. Further, the conical shape of the sleeve 102, with the greater radius towards the second end may provide an increasing volume for the discharge gasses to expand along with an outward movement towards the second opening. Accordingly, the velocity of the discharge gasses may reduce, resulting in sound attenuation.

Figure 2:
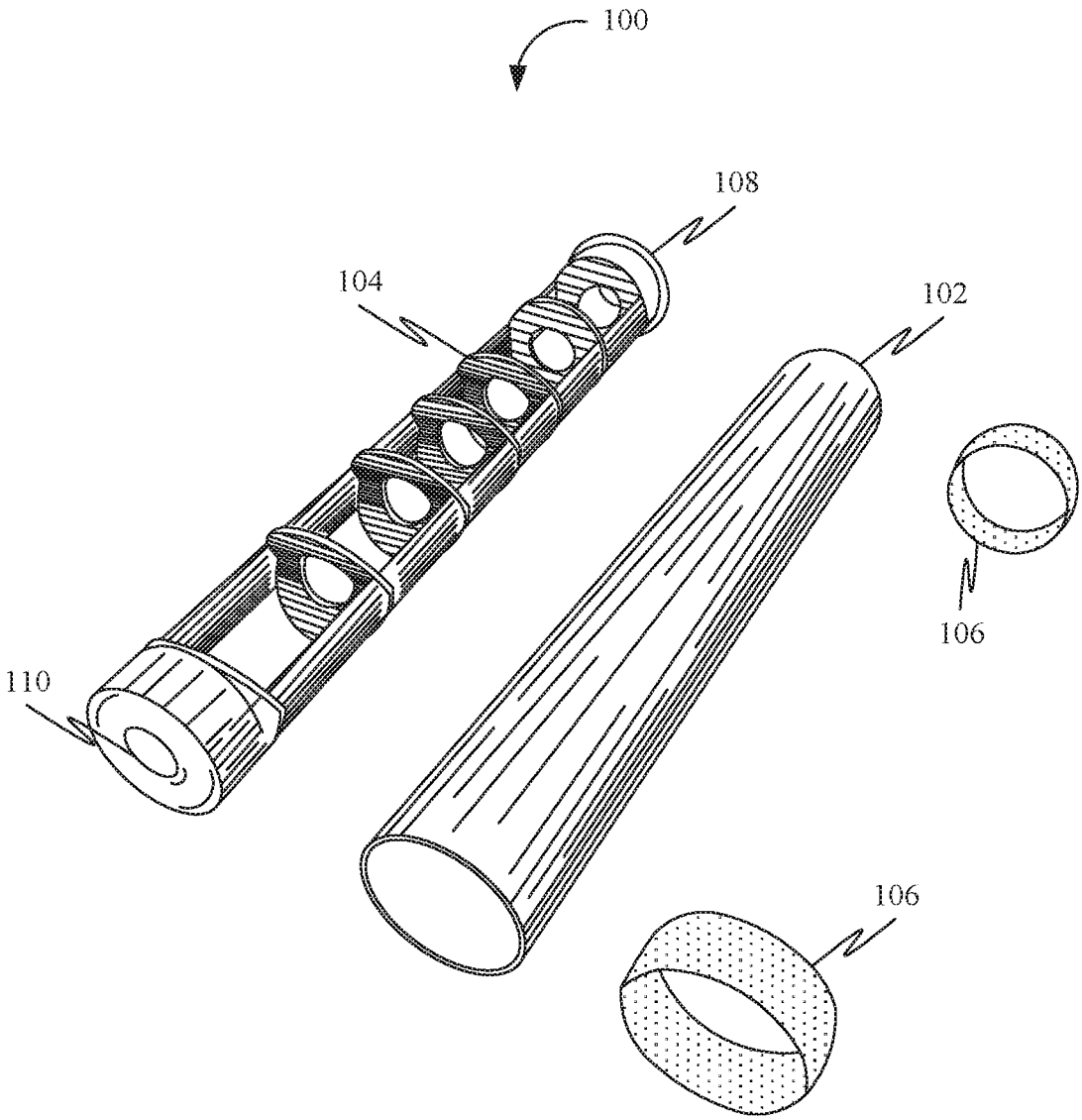
FIG. 2 is an exploded view of a firearm suppressor configured to be attached to a muzzle of a firearm including a fastening mechanism, in accordance with some embodiments.

Further, in some embodiments, the firearm suppressor 100 may include at least one fastening mechanism 106 (as shown in FIG. 2) configured to removably secure the sleeve 102 to the suppressor body 104 upon the sleeve 102 enclosing the suppressor body 104. Further, the at least one fastening mechanism 106 may include a drawstring configured to removably secure the sleeve 102 to the suppressor body 104. Further, upon the sleeve 102 enclosing the suppressor body 104, the drawstring may be configured to be rolled around the sleeve 102, and knotted to secure the sleeve 102 to the suppress body 104. Further, in an instance, the at least one fastening mechanism 106 may include a plurality of clamps configured to removably secure the sleeve 102 to the suppressor body 104. Further, upon the sleeve 102 enclosing the suppressor body 104, the plurality of clamps may be configured to be placed towards the first end 108, and the second end 110 of the suppressor body 104. Further, the plurality of clamps may be configured to be fastened around the sleeve 102, such as using adjustable screws to secure the sleeve 102 to the suppressor body 104. Further, in an instance, the at least one fastening mechanism 106 may include at least one of a Velcro strap, a quick release clasp, an elastic band, and a screw-on clasp.

Figure 3:
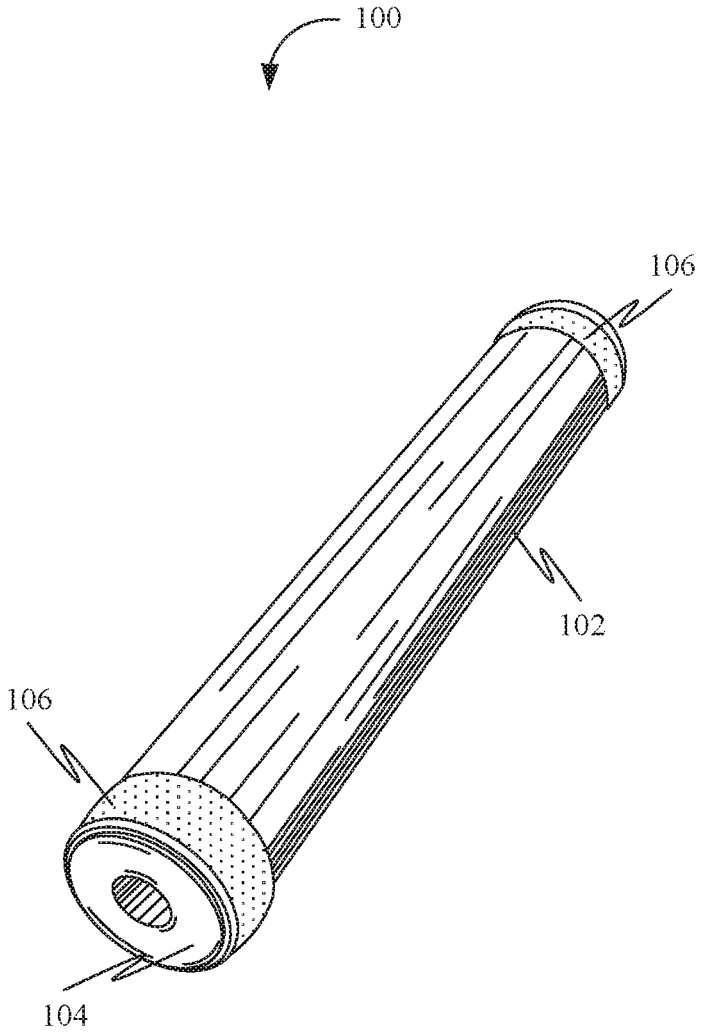
FIG. 3 is an assembled view of a firearm suppressor including a sleeve, a suppressor body, and a fastening mechanism, in accordance with some embodiments.
Figure 18:
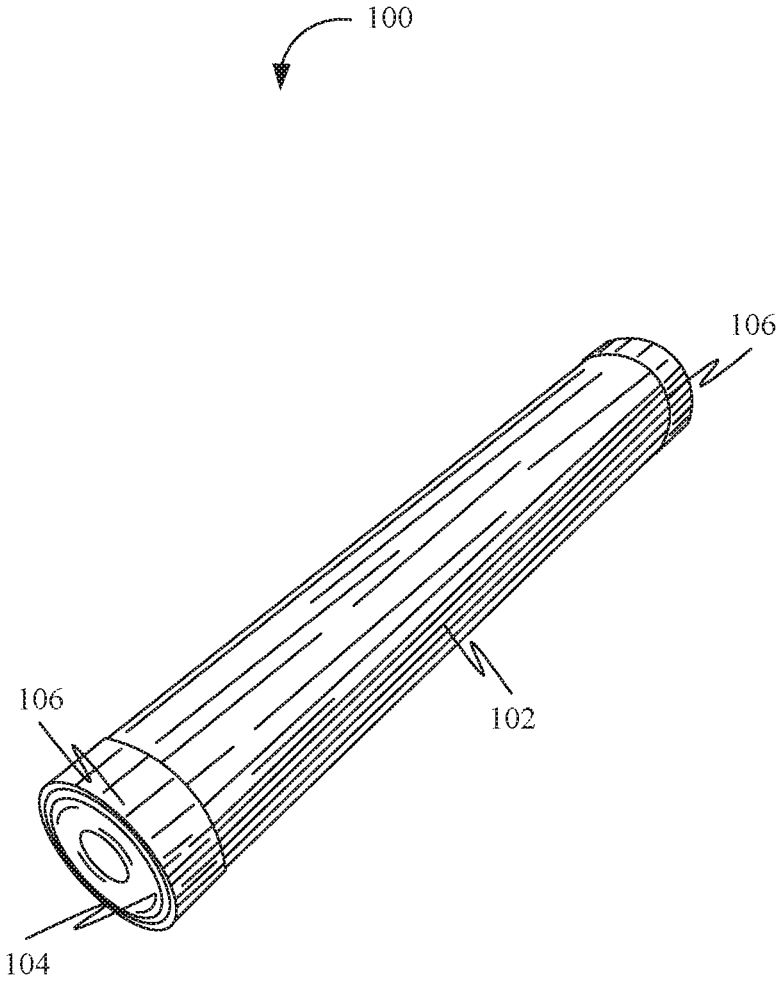
FIG. 18 is an assembled view of a firearm suppressor including a sleeve, a suppressor body, and a metallic fastening mechanism, in accordance with some embodiments.

Further, in some embodiments, the suppressor body 104 may be configured to accommodate at least one baffle. Further, the at least one baffle may be configured to reduce a velocity of discharge gasses entering the firearm suppressor 100 from the first baffle opening along with the discharged ammunition round. Further, the at least one baffle may be configured to guide the discharge gasses towards the second baffle opening. FIG. 3 is an assembled view of the firearm suppressor 100 including the sleeve 102, the suppressor body 104, and the fastening mechanism 106. Further, FIG. 18 is an assembled view of the firearm suppressor 100 including the sleeve 102, the suppressor body 104, and the fastening mechanism 106, wherein the fastening member 106 may include a metallic fastening member 106 permanently secure the sleeve 102 to the suppressor body 104.

Figure 14:
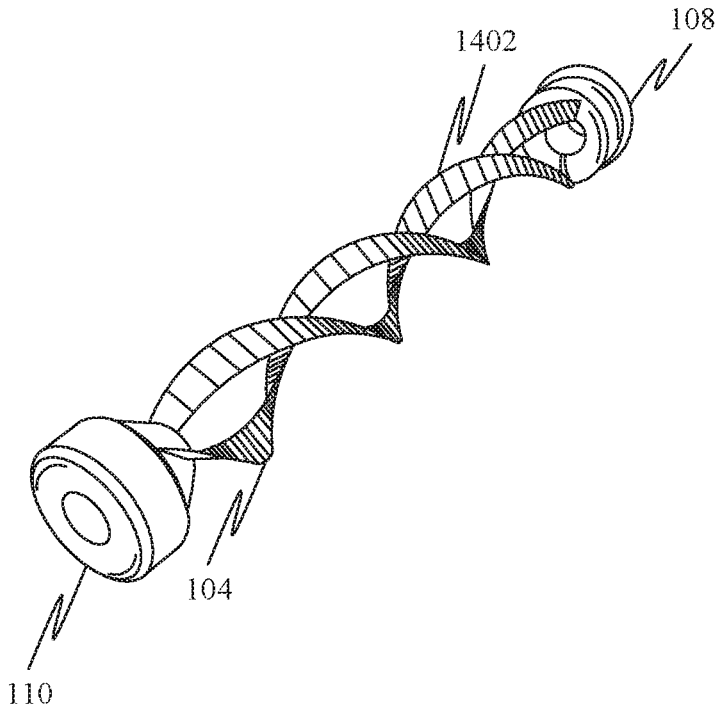
FIG. 14 is a perspective view of a suppressor body with a plurality of helical support members, in accordance with some embodiments.
Figure 15:
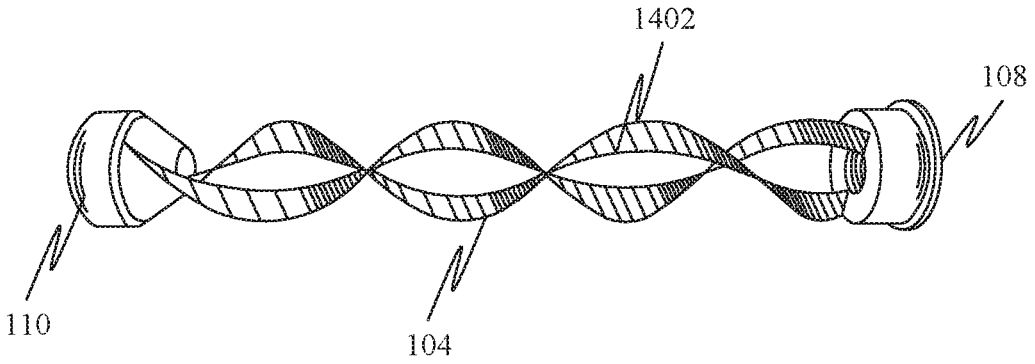
FIG. 15 is a side view of a suppressor body with a plurality of helical support members, in accordance with some embodiments.
Figure 16:
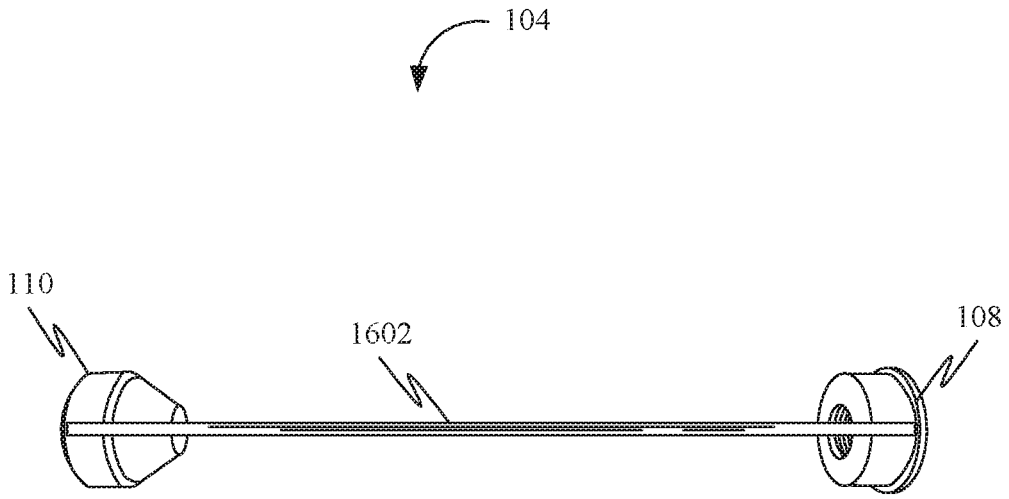
FIG. 16 is a side view of a suppressor body with at least one vertical support members, in accordance with some embodiments.

Further, in some embodiments, the suppressor body 104 may include at least one of a plurality of helical support members 1402 (as shown in FIG. 14), and a plurality of spiral support members connecting the first end 108 and the second end 110. Further, the at least one of the plurality of helical support members 1402, and the plurality of spiral support members may function as baffles and as structural elements. Further, the functioning of the at least one of the plurality of helical support members 1402, and the plurality of spiral support members as baffles may allow for a reduction in weight of the firearm suppressor. Further, FIG. 15 is a side view of the suppressor body 104 with the plurality of helical support members 1402, in accordance with some embodiments.

Figure 17:
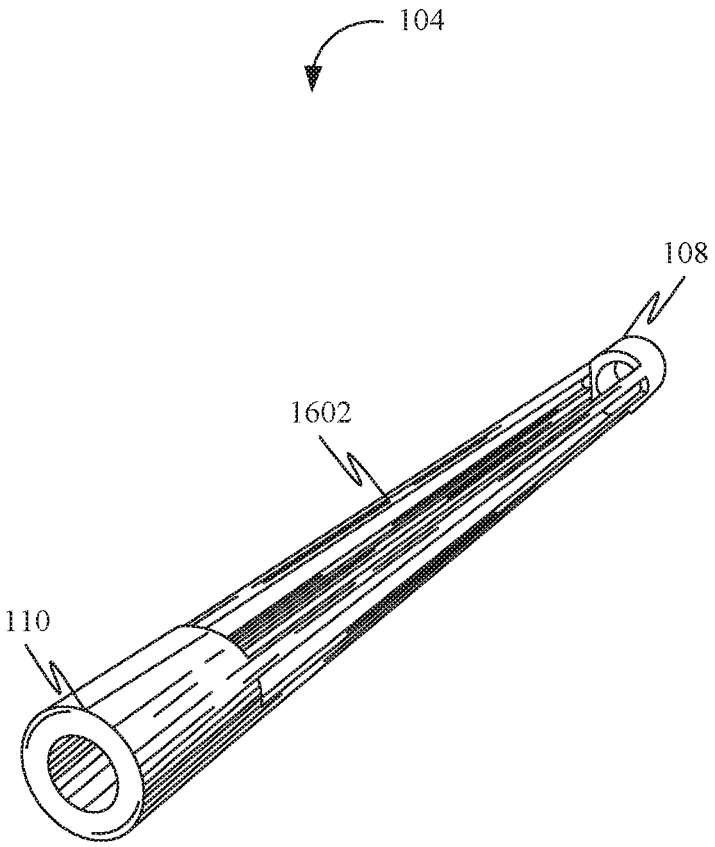
FIG. 17 is a perspective view of a suppressor body with at least one vertical support members, in accordance with some embodiments.

Further, in some embodiments, the suppressor body 104 may include at least one of a vertical support member 1602 (as shown in FIG. 17) connecting the first end 108 and the second end 110. Further, the at least one of the vertical support member 1602 may function as baffles and as structural elements. Further, the functioning of the at least one of the vertical support member 1602 as baffles may allow for a reduction in weight of the firearm suppressor.

Further, FIG. 17 is a perspective view of the suppressor body 104 with at least one of a vertical support member 1602, in accordance with some embodiments.

Further, in some embodiments, the first suppressor opening may be configured to receive a Nielsen device attached to the muzzle of the firearm. Further, the Nielsen device may include a muzzle booster or recoil booster, which may be used to harness energy of discharge gasses escaping to augment a force of recoil on portions of the firearm, such as to improve reliability and/or rate of fire of a recoil operated firearm.

Figure 4:
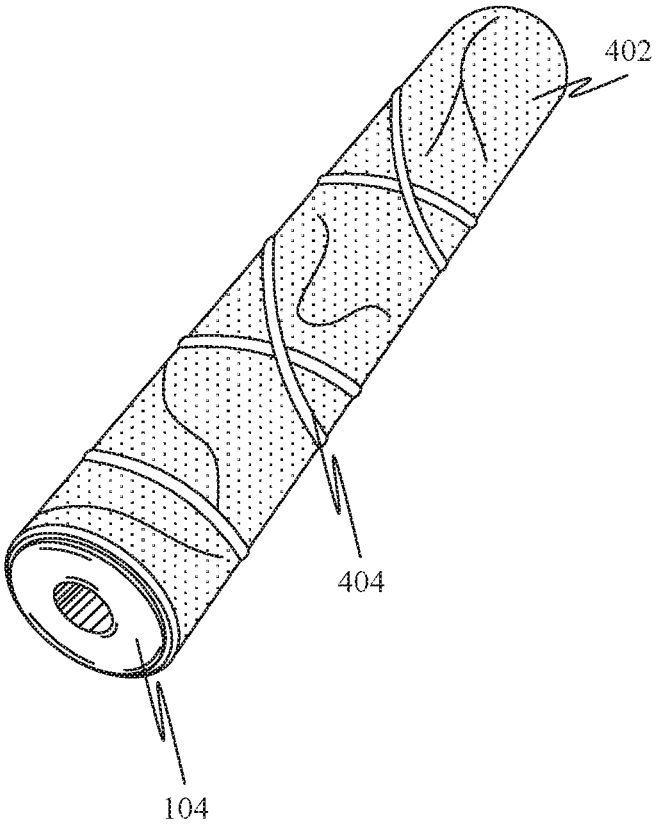
FIG. 4 is an assembled view of a firearm suppressor including a sleeve characterized by a planar member, in accordance with some embodiments.
Figure 5:
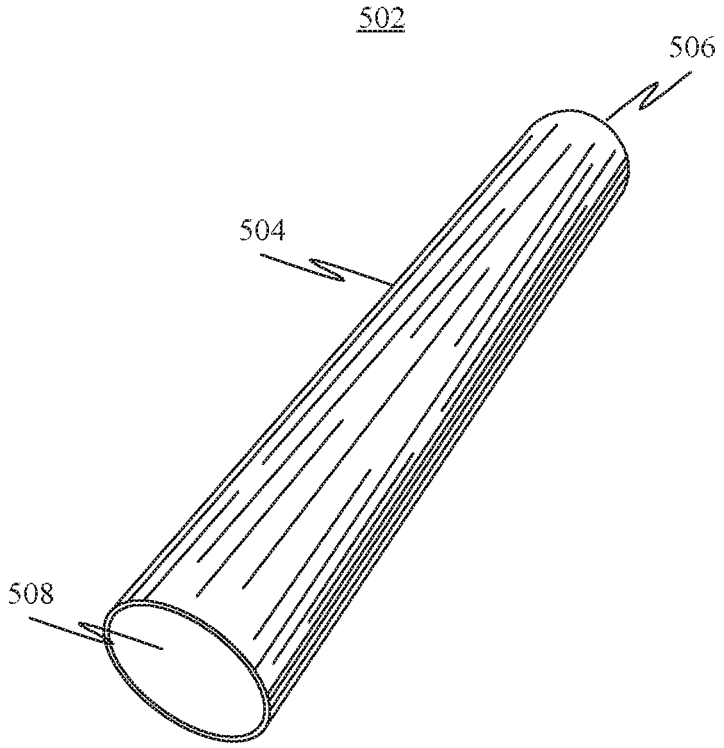
FIG. 5 is a perspective view of a flexible sleeve of a firearm suppressor, in accordance with some embodiments.

Further, as shown in FIG. 4 in some embodiments, the sleeve 102 may include a sleeve body 402 characterized by a planar member. Further, the sleeve body 402 may be configured to be enfolded around the suppressor body 104, as shown in FIG. 5. Further, the sleeve 102 may include at least one fastening mechanism 404 configured to removably secure the sleeve body 402 to the suppressor body 104 upon the sleeve body 402 being enfolded around the suppressor body 104. Further, in an embodiment, the sleeve body 402 characterized by the planar member may include multiple layers. Further, in an instance, the multiple layers may be constructed of different materials. For instance, if the sleeve body 402 is constructed of 3 layers, the 3 layers may be constructed of Kevlar, Rubber, and Carbon Foam. Further, in an instance, the multiple layers may be constructed of a same material. For instance, the sleeve 102 may be constructed of multiple layers of Kevlar, multiple layers of carbon foam, multiple layers of rubber, and so on.

Further, in some embodiments, the sleeve 102 may include a flexible sleeve 502, as shown in FIG. 5. Further, the flexible sleeve 502 may include an elongated housing 504 extending between a first opening 506 and a second opening 508. Further, the elongated housing 504 may include a hollow space. Further, the elongated housing 504 may be configured to envelop the suppressor body 104. Further, in an embodiment, the flexible sleeve 502 may be made up of an elastic material, such as elastomers including synthetic rubber, nitrile rubber, silicone rubber, and so on. Further, a shape of the flexible sleeve 502 may be similar to the suppressor body 104, so as to accommodate the suppressor body 104. For instance, the shape of the flexible sleeve 502 may be hollow cylindrical to accommodate the suppressor body 104 in the elongated housing 504. Further, a dimension of the flexible sleeve 502 may be less than the suppressor body 104, so that the flexible sleeve 502 may expand upon the suppressor body 104 being placed in the elongated housing 504, to securely accommodate the suppressor body in the elongated housing 504.

Figure 6:
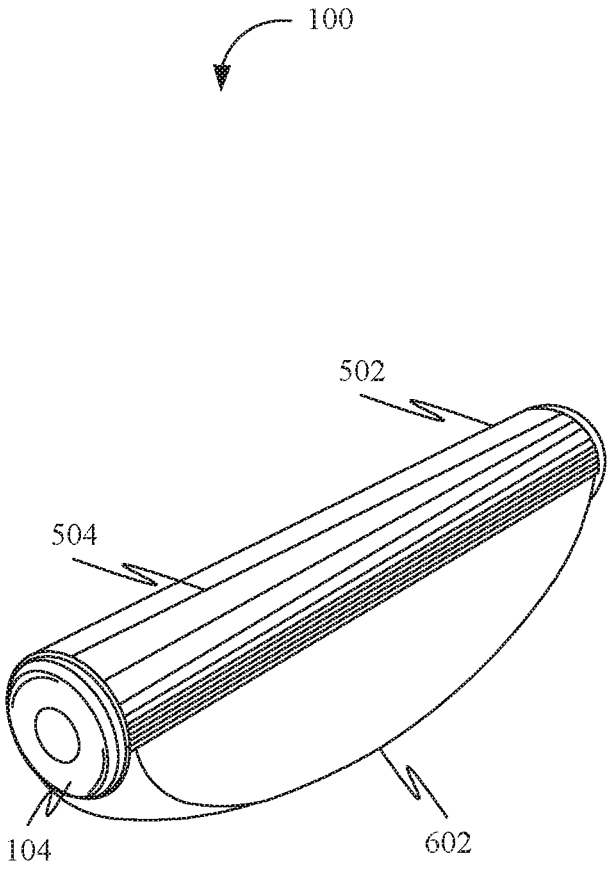
FIG. 6 is a firearm suppressor with a flexible sleeve including a bulbous portion, in accordance with some embodiments.
Figure 7:
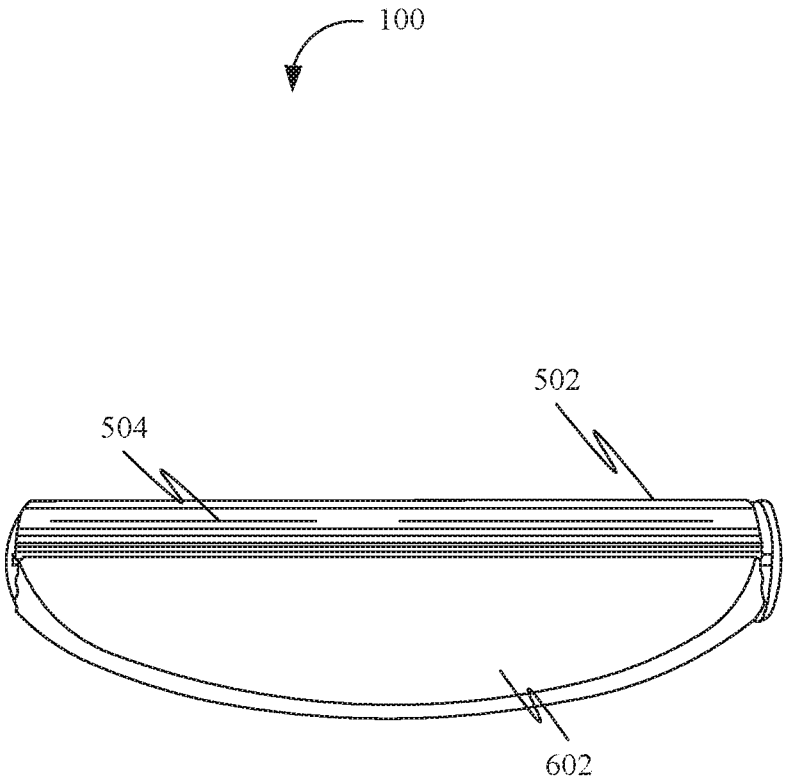
FIG. 7 is a side view of a firearm suppressor with a bulbous portion, in accordance with some embodiments.

Further, in some embodiments, as shown in FIG. 6. the elongated housing 504 may include a bulbous portion 602. Further, the bulbous portion 602 may include an enclosed volume. Further, FIG. 7 is a side view of the firearm suppressor 100 with the bulbous portion 602.

Further, in some embodiments, upon being attached to a barrel of a firearm, the bulbous portion 602 may be configured to allow discharge gasses released upon the discharge of an ammunition round to expand in the enclosed volume thereby reducing velocity of the discharge gasses. Further, the bulbous portion 602 may be configured to absorb a pressure impulse of the discharge gasses corresponding to a reduction of the velocity of the discharge gasses. Further, the absorbing of the pressure impulse may provide sound attenuation.

Figure 8:
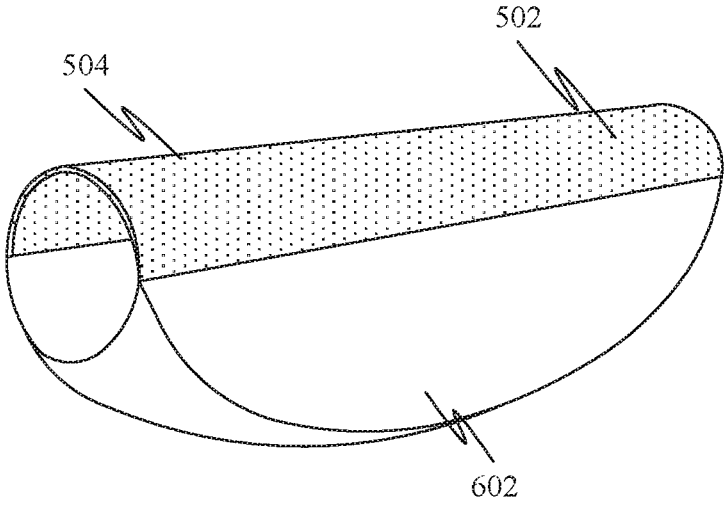
FIG. 8 is a flexible sleeve with a bulbous portion, wherein the flexible sleeve and the bulbous portion are constructed of different materials, in accordance with some embodiments.

Further, in an instance, the bulbous portion 602 may be constructed of the same material as the elongated housing 504. Further, in an instance, as shown in FIG. 8 the bulbous portion 602 may be constructed of a different material than the elongated housing 504. For instance, the bulbous portion 602 may be constructed of a flexible material. For instance, the bulbous portion 602 may be constructed of materials such as (but not limited to) leather, rubber, nylon, and/or any synthetic material (such as polyethylene), etc. Further, the bulbous portion 602 may be constructed of materials such as (but not limited to) Polyamides (PA) or (nylons), Polycarbonate (PC), Polyester (PES), Polyethylene (PE), High-density polyethylene (HDPE), Low-density polyethylene (LDPE), Polyethylene terephthalate (PET), Polypropylene (PP), Polystyrene (PS), High impact polystyrene (HIPS), Polyurethanes (PU), Polyvinyl chloride (PVC), Polyvinylidene chloride (PVDC), Acrylonitrile butadiene styrene (ABS), Polycarbonate/Acrylonitrile Butadiene Styrene (PC/ABS), Polyethylene/Acrylonitrile Butadiene Styrene (PE/ABS). Further, the at least one layer may be constructed of aramids, including, but not limited to Kevlar, Twaron, Nomex, New Star, and Teijinconex. Alternately, the elongated housing 504 may be constructed of a rigid material, such as Iron, Copper, Lead, Molybdenum, Nickel, Tin, Zinc, Titanium, Silver, Gold, Platinum, and/or alloys, etc.

Further, in an embodiment, the bulbous portion 602 may include multiple layers. Further, in an instance, the multiple layers may be constructed of different materials. For instance, if the bulbous portion 602 is constructed of 3 layers, the 3 layers may be constructed of Kevlar, Rubber, and Carbon Foam. Further, in an instance, the multiple layers may be constructed of a same material. For instance, the bulbous portion 602 may be constructed of multiple layers of Kevlar, multiple layers of carbon foam, multiple layers of rubber, and so on.

Figure 9:
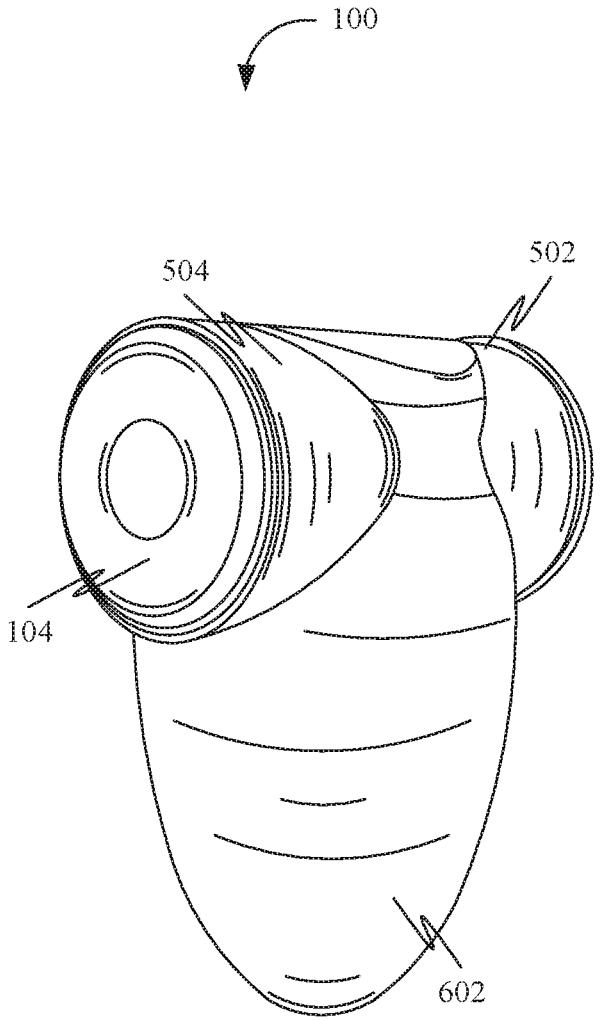
FIG. 9 is a firearm suppressor including a bulbous portion with a length of the bulbous greater than a length of a suppressor body, in accordance with some embodiments.

Further, in some embodiments, as shown in FIG. 9, a length of the bulbous portion 602 may be greater than a diameter of the suppressor body, or even greater than a length of the suppressor body 104, allowing for the firearm suppressor 100 to enclose a similar volume with a shorter length.

Figure 10:
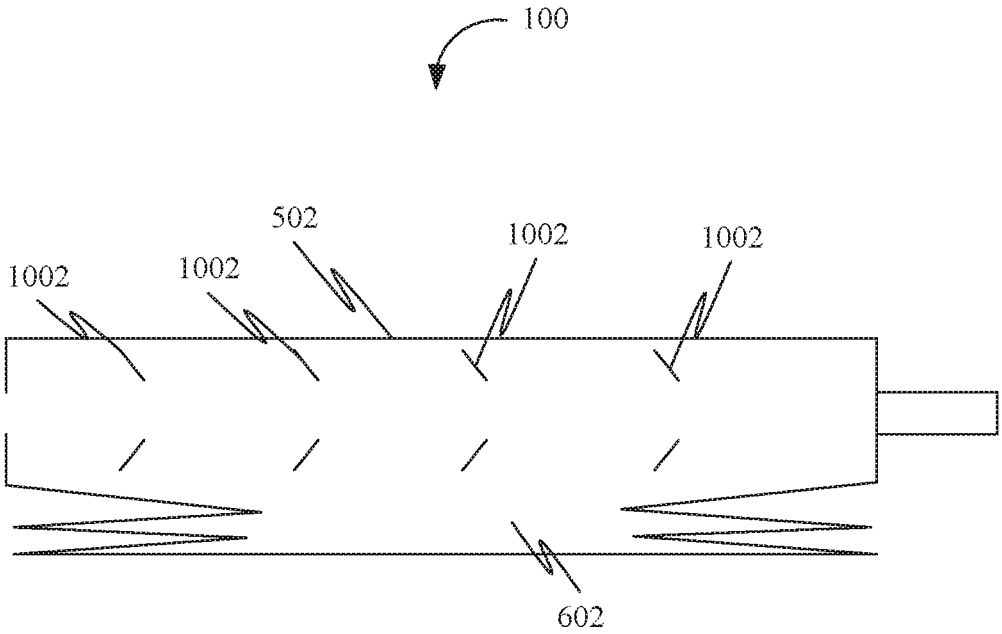
FIG. 10 is a firearm suppressor including a bulbous portion in a collapsed state, in accordance with some embodiments.
Figure 11:
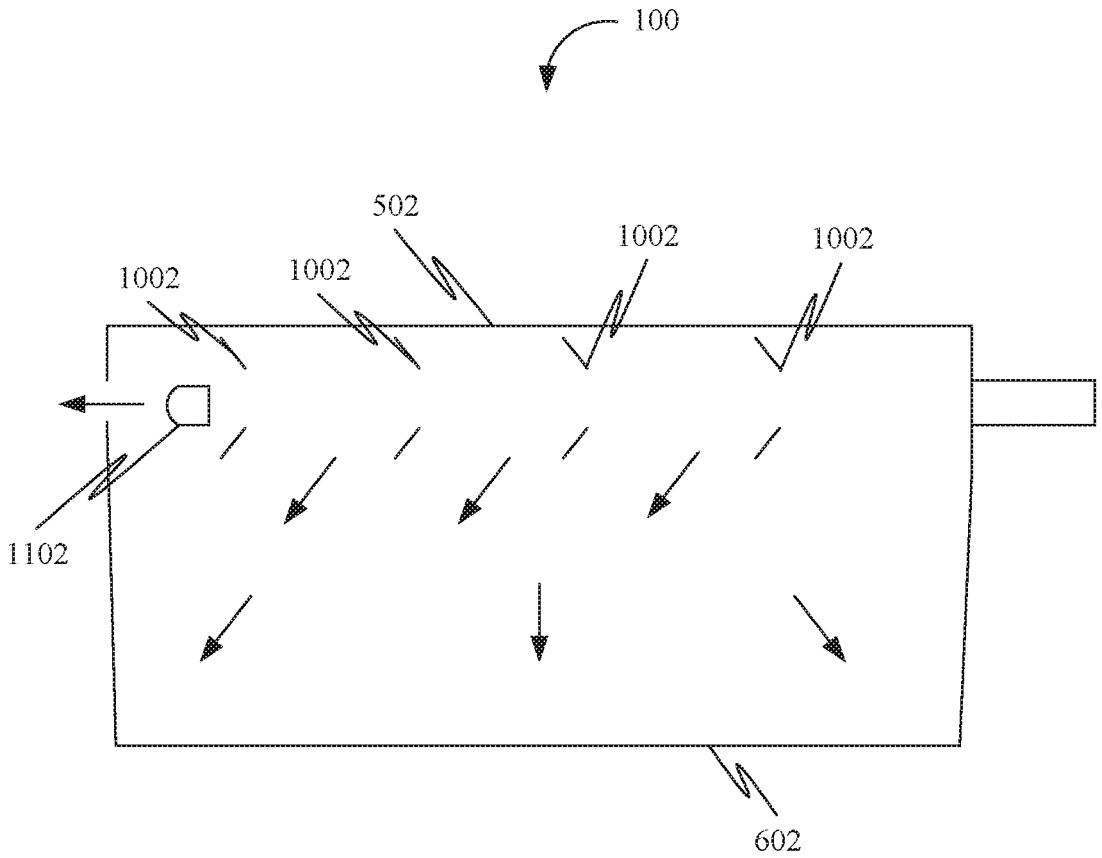
FIG. 11 is a firearm suppressor with including a bulbous portion in an open state, in accordance with some embodiments.

Further, in some embodiments, the bulbous portion 602 may be configured to remain in one of a collapsed state, as shown in FIG. 10, and an open state, as shown in FIG. 11. Further, the bulbous portion 602 may be configured to be crumpled around the suppressor body 104 in the collapsed sleeve 102. Further, the enclosed volume may be minimal in the collapsed state. Further, the bulbous portion 602 may be configured to be expanded in the open state. Further, the enclosed volume may be maximum in the open state. Further, as shown in FIG. 10, one or more baffles 1002 may be attached to the suppressor body 104 enclosed by the flexible sleeve 502. Further, the bulbous portion 602 may be crumpled or folded tightly against the suppressor body 104 to make when not in use. Further, as shown in FIG. 11, when an ammunition round is discharged, a bullet 1102 may travel the firearm suppressor 100, at which point expanding discharge gasses may cause the bulbous portion 602 to expand to the open state. Accordingly, the expansion of the bulbous portion 602 to the maximum enclosed volume may be automatic (caused by the discharge gasses). Further, in an embodiment, the expansion of the bulbous portion 602 may be manual, such as if a user pulls the bulbous portion 602 to the maximum enclosed volume.

Figure 12:
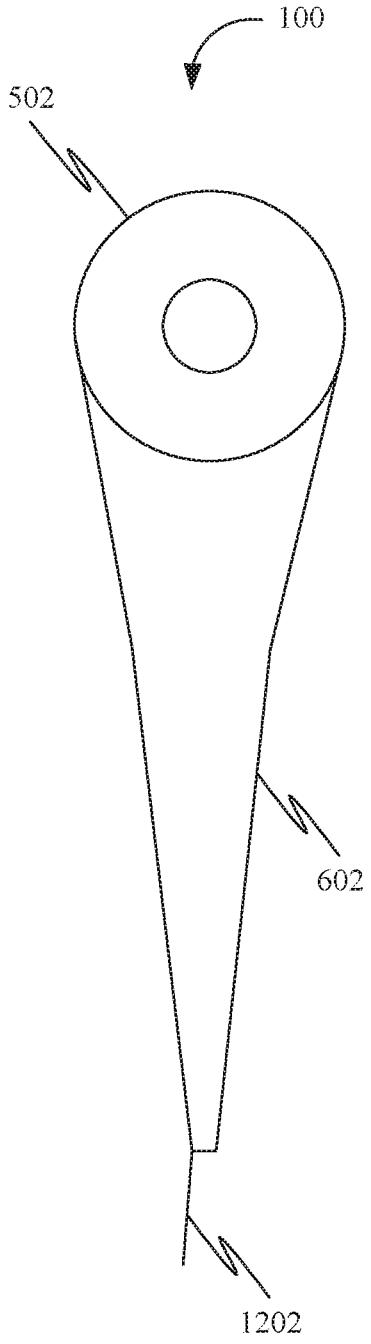
FIG. 12 is a front view of a firearm suppressor including a bulbous portion with a securing member, in accordance with some embodiments.

Further, in some embodiments, the flexible sleeve 502 may include a securing device 1202, as shown in FIG. 12 to maintain the bulbous portion 602 in the collapsed state.

Figure 13:
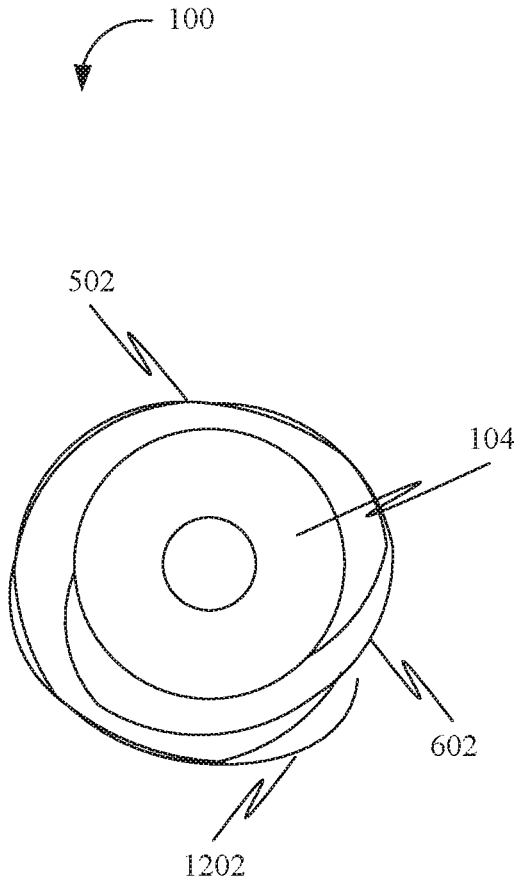
FIG. 13 is a firearm suppressor including a bulbous portion in a wrapped state, in accordance with some embodiments.

Further, in some embodiments, as shown in FIG. 13, the bulbous portion 602 may be configured to be wrapped along a circumference of the firearm suppressor 100 corresponding to a wrapped state. Further, the securing device 1202 may be configured to maintain the bulbous portion 602 in the wrapped state.

Further, in some embodiments, the sleeve 102 may include multiple layers, and may include a fastening mechanism, such as the at least one fastening mechanism 106. Further, in an instance, the multiple layers may be constructed of different materials. For instance, if the sleeve 102 is constructed of 3 layers, the 3 layers may be constructed of Kevlar, Rubber, and Carbon Foam. Further, in an instance, the multiple layers may be constructed of a same material. For instance, the sleeve 102 may be constructed of multiple layers of Kevlar, multiple layers of carbon foam, multiple layers of rubber, and so on. Further, the fastening mechanism may include a drawstring configured to removably secure the sleeve 102 to the suppressor body 104. Further, upon the sleeve 102 enclosing the suppressor body 104, the drawstring may be configured to be rolled around the sleeve 102, and knotted to secure the sleeve 102 to the suppress body 104. Further, in an instance, the fastening mechanism may include a plurality of clamps configured to removably secure the sleeve 102 to the suppressor body 104. Further, upon the sleeve 102 enclosing the suppressor body 104, the plurality of clamps may be configured to be placed towards the first end 108, and the second end 110 of the suppressor body. Further, the plurality of clamps may be configured to be fastened around the sleeve 102, such as using adjustable screws to secure the sleeve 102 to the suppressor body 104. Further, in an instance, the fastening mechanism may include at least one of a Velcro strap, a quick release clasp, an elastic band, and a screw-on clasp.

Further, in an embodiment, the sleeve 102 may include a single layer, and may include a bulbous portion (such as the bulbous portion 602). Further, the bulbous portion may include an enclosed volume. Further, in some embodiments, upon being attached to a barrel of a firearm, the bulbous portion may be configured to allow discharge gasses released upon the discharge of an ammunition round to expand in the enclosed volume thereby reducing velocity of the discharge gasses. Further, the bulbous portion may be configured to absorb a pressure impulse of the discharge gasses corresponding to a reduction of the velocity of the discharge gasses. Further, the absorbing of the pressure impulse may provide sound attenuation. Further, in an instance, the bulbous portion may be constructed of the same material as the sleeve 102. Further, in an instance, the bulbous portion may be constructed of a different material than the sleeve 102. For instance, the bulbous portion may be constructed of materials such as (but not limited to) leather, rubber, nylon, and/or any synthetic material (such as polyethylene), etc. Further, the bulbous portion may be constructed of materials such as (but not limited to) Polyamides (PA) or (nylons), Polycarbonate (PC), Polyester (PES), Polyethylene (PE), High-density polyethylene (HDPE), Low-density polyethylene (LDPE), Polyethylene terephthalate (PET), Polypropylene (PP), Polystyrene (PS), High impact polystyrene (HIPS), Polyurethanes (PU), Polyvinyl chloride (PVC), Polyvinylidene chloride (PVDC), Acrylonitrile butadiene styrene (ABS), Polycarbonate/Acrylonitrile Butadiene Styrene (PC/ABS), Polyethylene/Acrylonitrile Butadiene Styrene (PE/ABS). Further, the at least one layer may be constructed of aramids, including, but not limited to Kevlar, Twaron, Nomex, New Star, and Teijinconex. Alternately, the sleeve 102 may be constructed of a rigid material, such as Iron, Copper, Lead, Molybdenum, Nickel, Tin, Zinc, Titanium, Silver, Gold, Platinum, and/or alloys, etc.

Further, in some embodiments, the bulbous portion may comprise a rigid material. For instance, the bulbous portion may comprise materials such as Iron, Copper, Lead, Molybdenum, Nickel, Tin, Zinc, Titanium, Silver, Gold, Platinum, and/or alloys, etc. Further, the bulbous portion may provide sound attenuation by allowing the discharge gasses to expand in the enclosed volume, reducing a pressure energy of the discharge gasses.

Further, in an embodiment, the sleeve 102 may include multiple layers, and may include a bulbous portion, such as the bulbous portion 602. Further, in an instance, the multiple layers may be constructed of different materials. For instance, if the sleeve 102 is constructed of 3 layers, the 3 layers may be constructed of Kevlar, Rubber, and Carbon Foam. Further, in an instance, the multiple layers may be constructed of a same material. For instance, the sleeve 102 may be constructed of multiple layers of Kevlar, multiple layers of carbon foam, multiple layers of rubber, and so on. Further, if the bulbous portion includes 3 layers, the 3 layers may be constructed of Kevlar, Rubber, and Carbon Foam. Further, in an instance, the multiple layers may be constructed of a same material. For instance, the sleeve 102 may be constructed of multiple layers of Kevlar, multiple layers of carbon foam, multiple layers of rubber, and so on. Further, the bulbous portion may include an enclosed volume. Further, in some embodiments, upon being attached to a barrel of a firearm, the bulbous portion may be configured to allow discharge gasses released upon the discharge of an ammunition round to expand in the enclosed volume thereby reducing velocity of the discharge gasses. Further, the bulbous portion may be configured to absorb a pressure impulse of the discharge gasses corresponding to a reduction of the velocity of the discharge gasses. Further, the absorbing of the pressure impulse may provide sound attenuation. Further, in an instance, the bulbous portion may be constructed of the same material as the sleeve 102. Further, in an instance, the bulbous portion may be constructed of a different material than the sleeve 102. For instance, the bulbous portion may be constructed of materials such as (but not limited to) leather, rubber, nylon, and/or any synthetic material (such as polyethylene), etc. Further, the bulbous portion may be constructed of materials such as (but not limited to) Polyamides (PA) or (nylons), Polycarbonate (PC), Polyester (PES), Polyethylene (PE), High-density polyethylene (HDPE), Low-density polyethylene (LDPE), Polyethylene terephthalate (PET), Polypropylene (PP), Polystyrene (PS), High impact polystyrene (HIPS), Polyurethanes (PU), Polyvinyl chloride (PVC), Polyvinylidene chloride (PVDC), Acrylonitrile butadiene styrene (ABS), Polycarbonate/Acrylonitrile Butadiene Styrene (PC/ABS), Polyethylene/Acrylonitrile Butadiene Styrene (PE/ABS). Further, the at least one layer may be constructed of aramids, including, but not limited to Kevlar, Twaron, Nomex, New Star, and Teijinconex. Alternately, the sleeve 102 may be constructed of a rigid material, such as Iron, Copper, Lead, Molybdenum, Nickel, Tin, Zinc, Titanium, Silver, Gold, Platinum, and/or alloys, etc. Further, the sleeve 102 may include a fastening mechanism, such as the at least one fastening mechanism 106. Further, the fastening mechanism may include a drawstring configured to removably secure the sleeve 102 to the suppressor body 104. Further, upon the sleeve 102 enclosing the suppressor body 104, the drawstring may be configured to be rolled around the sleeve 102, and knotted to secure the sleeve 102 to the suppress body 104. Further, in an instance, the fastening mechanism may include a plurality of clamps configured to removably secure the sleeve 102 to the suppressor body 104. Further, upon the sleeve 102 enclosing the suppressor body 104, the plurality of clamps may be configured to be placed towards the first end 108, and the second end 110 of the suppressor body 104. Further, the plurality of clamps may be configured to be fastened around the sleeve 102, such as using adjustable screws to secure the sleeve 102 to the suppressor body 104. Further, in an instance, the fastening mechanism may include at least one of a Velcro strap, a quick release clasp, an elastic band, and a screw-on clasp.

According to some embodiments, a firearm suppressor configured to be attached to a muzzle of a firearm is disclosed. Further, the firearm suppressor may include a flexible sleeve configured to envelop a suppressor body. Further, the flexible sleeve may include an elongated housing extending between a first opening and a second opening. Further, the elongated housing may include a hollow space. Further, the elongated housing may be configured to envelop the suppressor body. Further, the flexible sleeve may include at least one layer. Further, the at least one layer is constructed, at least in part, of a flexible material. Further, the firearm suppressor may include the suppressor body. Further, the suppressor body may extend between a first end and a second end. Further, the first end may include a first suppressor opening. Further, the first end may be configured to be physically coupled to the muzzle of the firearm. Further, the second end may include a second suppressor opening configured to provide an outlet to a discharged ammunition round from the firearm.

Further, in some embodiments, upon the firearm suppressor being attached to a barrel of a firearm, the flexible sleeve may be configured to momentarily expand under a pressure impulse of discharge gasses released along with a discharged ammunition round and absorb a pressure impact of the discharge gasses. Further, the momentary expansion of the flexible sleeve and absorbing of the pressure impact provides sound attenuation.

Further, in some embodiments, the elongated housing may include a bulbous portion. Further, the bulbous portion may include an enclosed volume.

Further, in some embodiments, upon the firearm suppressor being attached to a barrel of a firearm, the bulbous portion may be configured to allow discharge gasses released upon the discharge of an ammunition round to expand in the enclosed volume thereby reducing velocity of the discharge gasses. Further, the bulbous portion may be configured to absorb a pressure impulse of the discharge gasses corresponding to a reduction of the velocity of the discharge gasses. Further, the absorbing of the pressure impulse provides a sound attenuation.

Further, in some embodiments, the sleeve may include a sleeve body characterized by a planar member. Further, the sleeve body may be configured to be enfolded around the suppressor body. Further, the sleeve may include at least one fastening mechanism configured to removably secure the sleeve body to the suppressor body upon the sleeve body being enfolded around the suppressor body.

Further, in some embodiments, the firearm suppressor may comprise at least one fastening mechanism configured to removably secure the sleeve to the suppressor body upon the sleeve enclosing the suppressor body.

Further, in some embodiments, the first suppressor opening may be configured to receive a Nielsen device attached to the muzzle of the firearm.

According to some embodiments, a firearm with an attached firearm suppressor is disclosed. Further, the firearm may include, but may not be limited to a handgun, a long gun, a rifle, and a shotgun. Further, the firearm suppressor may include a sleeve configured to envelop a suppressor body. Further, the sleeve may include at least one layer. Further, the at least one layer may be constructed, at least in part, of a flexible material. Further, the firearm suppressor may include the suppressor body. Further, the suppressor body may extend between a first end and a second end. Further, the first end may include a first suppressor opening. Further, the first end may be configured to be physically coupled to the muzzle of the firearm. Further, the second end may include a second suppressor opening configured to provide an outlet to a discharged ammunition round from the firearm. Further, in some embodiments, the firearm suppressor may be permanently attached to the muzzle of the firearm. Further, in an embodiment, the firearm suppressor may be detachable from the firearm. Further, in some embodiments, the sleeve of the firearm suppressor may comprise a heat resistant material. Further, the heat resistant material may include at least one of Polybenzimidazole (PBI), Aramids—para and meta, FR cotton, Coated Nylon, Carbon foam (CFOAM), Polyhydroquinone—dimidazopyridine, Melamine, Modacrylic, and Leather. Further, the heat resistant material may reduce a heat signature of the firearm suppressor, and may allow the firearm to be used more effectively in hunting or other operations requiring stealth. Further. the heat resistant material may reduce a temperature of the firearm suppressor, and may allow the firearm suppressor to be detached from the firearm safely. Further, in an embodiment, the firearm suppressor may include a temperature sensor configured to sense an internal temperature of the firearm suppressor, and an ambient temperature. Further, the firearm suppressor may include a coolant storage and dispatch mechanism. Further, the temperature sensor may control the dispatch of the coolant after discharge of an ammunition round to maintain the internal temperature of the firearm suppressor in a predetermined range of the ambient temperature. Further, in some embodiments, the sleeve may include a flexible sleeve. Further, the flexible sleeve may include an elongated housing extending between a first opening and a second opening. Further, the elongated housing may include a hollow space. Further, the elongated housing may be configured to envelop the suppressor body. Further, in some embodiments, the firearm suppressor may include at least one fastening mechanism configured to removably secure the sleeve to the suppressor body upon the sleeve enclosing the suppressor body. Further, the sleeve may be configured to momentarily expand under a pressure impulse of discharge gasses released along with a discharged ammunition round and absorb a pressure impact of the discharge gasses. Further, the momentary expansion of the sleeve and absorbing of the pressure impact provides sound attenuation. Further, the elongated housing may include a bulbous portion. Further, the bulbous portion may include an enclosed volume. Further, in some embodiments, upon being attached to a barrel of a firearm, the bulbous portion may be configured to allow discharge gasses released upon the discharge of an ammunition round to expand in the enclosed volume thereby reducing velocity of the discharge gasses. Further, the bulbous portion may be configured to absorb a pressure impulse of the discharge gasses corresponding to a reduction of the velocity of the discharge gasses. Further, the absorbing of the pressure impulse provides a sound attenuation. Further, in some embodiments, the bulbous portion may be configured to remain in a collapsed state and an open state. Further, the bulbous portion may be configured to be crumpled around the suppressor body in the collapsed sleeve. Further, the enclosed volume may be minimal in the collapsed state. Further, the bulbous portion may be configured to be expanded in the open state. Further, the enclosed volume may be maximum in the open state. Further, in some embodiments, the flexible sleeve may include a securing device to maintain the bulbous portion in the collapsed state. Further, in some embodiments, the bulbous portion may be configured to be wrapped along a circumference of the firearm suppressor corresponding to a wrapped state. Further, the securing device may be configured to maintain the portion in the wrapped state.

Further, in some embodiments, the suppressor body may be configured to accommodate at least one baffle. Further, the at least one baffle may be configured to reduce a velocity of discharge gasses entering the firearm suppressor from the first baffle opening along with the discharged ammunition round. Further, the at least one baffle may be configured to guide the discharge gasses towards the second baffle opening. Further, in some embodiments, the sleeve may include a sleeve body characterized by a planar member. Further, the sleeve body may be configured to be enfolded around the suppressor body. Further, the sleeve may include at least one fastening mechanism configured to removably secure the sleeve body to the suppressor body upon the sleeve body being enfolded around the suppressor body. Further, in some embodiments, the suppressor body may include at least one of a plurality of helical support members and a plurality of spiral support members connecting the first end and the second end. Further, the at least one of the plurality of helical support members, and the plurality of spiral support members may function as baffles and as structural elements. Further, the functioning of the at least one of the plurality of helical support members, and the plurality of spiral support members as baffles may allow for a reduction in weight of the firearm suppressor. Further, in some embodiments, the first suppressor opening may be configured to receive a Nielsen device attached to the muzzle of the firearm.

According to some embodiments, a suppressor sleeve configured to be attached to a firearm suppressor is disclosed. Further, the suppressor sleeve may be configured to envelop the firearm suppressor. Further, the suppressor sleeve may include at least one layer. Further, the at least one layer may be constructed, at least in part, of a flexible material. Further, in some embodiments, the suppressor sleeve may include a flexible sleeve. Further, the flexible sleeve may include an elongated housing extending between a first opening and a second opening. Further, the elongated housing may include a hollow space. Further, the elongated housing may be configured to envelop the suppressor body. Further, upon a firearm suppressor being attached to a barrel of a firearm, the suppressor sleeve may be configured to momentarily expand under a pressure impulse of discharge gasses released along with a discharged ammunition round and absorb a pressure impact of the discharge gasses. Further, the momentary expansion of the sleeve and absorbing of the pressure impact provides sound attenuation. Further, the elongated housing may include a bulbous portion. Further, the bulbous portion may include an enclosed volume. Further, in some embodiments, upon being attached to a barrel of a firearm, the bulbous portion may be configured to allow discharge gasses released upon the discharge of an ammunition round to expand in the enclosed volume thereby reducing velocity of the discharge gasses. Further, the bulbous portion may be configured to absorb a pressure impulse of the discharge gasses corresponding to a reduction of the velocity of the discharge gasses. Further, the absorbing of the pressure impulse provides a sound attenuation. Further, in some embodiments, the bulbous portion may be configured to remain in a collapsed state and an open state. Further, the bulbous portion may be configured to be crumpled around the suppressor body in the collapsed sleeve. Further, the enclosed volume may be minimal in the collapsed state. Further, the bulbous portion may be configured to be expanded in the open state. Further, the enclosed volume may be maximum in the open state. Further, in some embodiments, the flexible sleeve may include a securing device to maintain the bulbous portion in the collapsed state. Further, in some embodiments, the bulbous portion may be configured to be wrapped along a circumference of the firearm suppressor corresponding to a wrapped state. Further, the securing device may be configured to maintain the portion in the wrapped state. Further, in some embodiments, the suppressor sleeve may include a sleeve body characterized by a planar member. Further, the sleeve body may be configured to be enfolded around the suppressor body. Further, the sleeve may include at least one fastening mechanism configured to removably secure the sleeve body to the suppressor body upon the sleeve body being enfolded around the suppressor body.

What is claimed is:

1. A firearm suppressor configured to be attached to a muzzle of a firearm, wherein the firearm suppressor comprises:

a sleeve configured to envelop a suppressor body, wherein the sleeve comprises at least one layer, wherein the at least one layer is constructed, at least in part, of a flexible material, wherein the sleeve is attached to the suppressor body, wherein the sleeve comprises a sleeve body, wherein the sleeve body is configured to be enfolded around the suppressor body when not in use, wherein the sleeve further comprises at least one fastening mechanism configured to removably secure the sleeve body to the suppressor body upon the sleeve body being enfolded around the suppressor body, wherein the sleeve comprises a flexible sleeve, wherein the flexible sleeve comprises an elongated housing extending between a first opening and a second opening, wherein the elongated housing comprises a hollow space, wherein the elongated housing is configured to envelop the suppressor body, wherein the elongated housing comprises a bulbous portion, wherein the bulbous portion comprises an enclosed volume, wherein a length of the bulbous portion is greater than a length of the suppressor body; and the suppressor body, wherein the suppressor body extends between a first end and a second end, wherein the first end comprises a first suppressor opening, wherein the first end is configured to be physically coupled to the muzzle of the firearm, wherein the second end comprises a second suppressor opening configured to provide an outlet to a discharged ammunition round from the firearm.

2. The firearm suppressor of claim 1, wherein the sleeve is configured to momentarily expand under a pressure impulse of discharge gasses released along with a discharged ammunition round and absorb a pressure impact of the discharge gasses, wherein the momentary expansion of the sleeve and absorbing of the pressure impact provides sound attenuation.

3. The firearm suppressor of claim 1, wherein the bulbous portion is configured to allow discharge gasses released upon the discharge of an ammunition round to expand in the enclosed volume thereby reducing a velocity of the discharge gasses, wherein the bulbous portion is configured to absorb a pressure impulse of the discharge gasses corresponding to a reduction of the velocity of the discharge gasses, wherein the absorbing of the pressure impulse provides a sound attenuation.

4. The firearm suppressor of claim 1, wherein the bulbous portion is configured to remain in a collapsed state, and an open state, wherein the bulbous portion is configured to be crumpled around the suppressor body in the collapsed sleeve, wherein the enclosed volume is minimal in the collapsed state, wherein the bulbous portion is configured to be expanded in the open state, wherein the enclosed volume is maximum in the open state.

5. The firearm suppressor of claim 4, wherein the flexible sleeve comprises a securing device to maintain the bulbous portion in the collapsed state.

6. The firearm suppressor of claim 5, wherein the bulbous portion is configured to be wrapped along a circumference of the firearm suppressor corresponding to a wrapped state, wherein the securing device is configured to maintain the bulbous portion in the wrapped state.

7. The firearm suppressor of claim 1, wherein the suppressor body is configured to accommodate at least one baffle, wherein the at least one baffle is configured to reduce a velocity of discharge gasses entering the firearm suppressor from the first baffle opening along with the discharged ammunition round, wherein the at least one baffle is configured to guide the discharge gasses towards the second baffle opening.

8. The firearm suppressor of claim 1, wherein the suppressor body comprises at least one of a plurality of helical support members, and a plurality of spiral support members connecting the first end and the second end, wherein the at least one of the plurality of helical support members, and the plurality of spiral support members function as baffles and as structural elements, wherein the functioning of the at least one of the plurality of helical support members, and the plurality of spiral support members as baffles allows for a reduction in a weight of the firearm suppressor.

9. The firearm suppressor of claim 1, wherein the first suppressor opening is configured to receive a Nielsen device attached to the muzzle of the firearm.

10. A firearm suppressor configured to be attached to a muzzle of a firearm, wherein the firearm suppressor comprises:

a flexible sleeve configured to envelop a suppressor body, wherein the flexible sleeve comprises an elongated housing extending between a first opening and a second opening, wherein the elongated housing comprises a hollow space, wherein the elongated housing is configured to envelop the suppressor body, wherein the flexible sleeve comprises at least one layer, wherein the at least one layer is constructed, at least in part, of a flexible material, wherein the flexible sleeve is attached to the suppressor body, wherein the flexible sleeve comprises a sleeve body, wherein the sleeve body is configured to be enfolded around the suppressor body, wherein the flexible sleeve further comprises at least one fastening mechanism configured to removably secure the sleeve body to the suppressor body upon the sleeve body being enfolded around the suppressor body, wherein the elongated housing comprises a bulbous portion, wherein the bulbous portion comprises an enclosed volume, wherein the bulbous portion is configured to be crumpled around the suppressor body when not in use; and the suppressor body, wherein the suppressor body extends between a first end and a second end, wherein the first end comprises a first suppressor opening, wherein the first end is configured to be physically coupled to the muzzle of the firearm, wherein the second end comprises a second suppressor opening configured to provide an outlet to a discharged ammunition round from the firearm.

11. The firearm suppressor of claim 10, wherein the flexible sleeve is configured to momentarily expand under a pressure impulse of discharge gasses released along with a discharged ammunition round and absorb a pressure impact of the discharge gasses, wherein the momentary expansion of the flexible sleeve and absorbing of the pressure impact provides sound attenuation.

12. The firearm suppressor of claim 10, wherein a length of the bulbous portion is greater than a length of the suppressor body.

13. The firearm suppressor of claim 12, wherein the bulbous portion is configured to allow discharge gasses released upon the discharge of an ammunition round to expand in the enclosed volume thereby reducing a velocity of the discharge gasses, wherein the bulbous portion is configured to absorb a pressure impulse of the discharge gasses corresponding to a reduction of the velocity of the discharge gasses, wherein the absorbing of the pressure impulse provides a sound attenuation.

14. The firearm suppressor of claim 11, wherein the sleeve comprises a heat resistant material.

* * * * *